US005633225A

United States Patent [19]

Fredj et al.

[11] Patent Number: 5,633,225

[45] Date of Patent: May 27, 1997

[54] DETERGENT COMPOSITIONS INHIBITING DYE TRANSFER

[75] Inventors: Abdennaceur Fredj, Brussels, Belgium; James P. Johnston, Overijse, Great Britain; Christiaan A. J. Thoen, Haasdonk, Belgium; Finlay MacCorquodale, Edinburgh, Scotland; Alfred Busch, Londerzeel, Belgium; Frederick E. Hardy, Ponteland, United Kingdom; Alan D. Willey, Cincinnati, Ohio

[73] Assignee: The Procter & Gamble Company, Cincinnati, Ohio

[21] Appl. No.: 373,259

[22] PCT Filed: Jun. 30, 1993

[86] PCT No.: PCT/US93/06222

§ 371 Date: Jan. 25, 1996

§ 102(e) Date: Jan. 25, 1996

[87] PCT Pub. No.: WO94/02579

PCT Pub. Date: Feb. 3, 1994

[30] Foreign Application Priority Data

| | | | |
|---|---|---|---|
| Jul. 15, 1992 | [EP] | European Pat. Off. | 92202168 |
| Apr. 26, 1993 | [EP] | European Pat. Off. | 93201198 |

[51] Int. Cl.[6] ..... C11D 3/37; C11D 1/00; C11D 3/39; C11D 3/395

[52] U.S. Cl. ..... 510/475; 510/500; 526/262; 526/265; 526/311

[58] Field of Search ..... 526/262, 265, 526/311; 510/475, 500

[56] References Cited

U.S. PATENT DOCUMENTS

| | | | |
|---|---|---|---|
| 4,545,919 | 10/1985 | Abel . | |
| 4,548,744 | 10/1985 | Connor | 252/545 |
| 5,403,906 | 4/1995 | Scriven et al. | 526/212 |
| 5,445,651 | 8/1995 | Thoen et al. | 8/111 |
| 5,451,337 | 9/1995 | Liu et al. | 252/102 |
| 5,458,809 | 10/1995 | Fredj et al. | 252/542 |
| 5,458,810 | 10/1995 | Fredj et al. | 252/542 |
| 5,460,752 | 10/1995 | Fredj et al. | 252/542 |
| 5,466,802 | 11/1995 | Panandiker et al. | 544/193.2 |
| 5,470,507 | 11/1995 | Fredj et al. | 252/542 |
| 5,474,576 | 12/1995 | Theon et al. | 8/111 |
| 5,478,489 | 12/1995 | Fredj et al. | 252/99 |

FOREIGN PATENT DOCUMENTS

| | | | |
|---|---|---|---|
| A20265257 | 4/1988 | European Pat. Off. | C11D 3/37 |
| 0327927A2 | 8/1989 | European Pat. Off. | C11D 3/37 |
| A2814329 | 4/1978 | Germany | C11D 3/28 |
| 1097450 | 1/1968 | United Kingdom . | |
| 1348212 | 3/1974 | United Kingdom | C11D 3/28 |

*Primary Examiner*—Douglas J. McGinty
*Assistant Examiner*—Michael P. Tierney
*Attorney, Agent, or Firm*—Michael D. Jones; George W. Allen; Jerry J. Yetter

[57] ABSTRACT

The present invention relates to a dye transfer inhibiting detergent composition comprising a) 0.0001% to 10% by weight of a dye transfer inhibitor having a ratio of amine to amine N-oxide of from about 2:3 to about 1:1,000,000 selected from the group consisting of poly(2-vinylpyridine-N-oxide), poly-2-(dimethylamino)-ethylmethacrylate-N-oxide and poly-1-vinylimidazole-N-oxide; and b) a detersive effective amount of a surfactant; and c) a detersive effective amount of a builder.

3 Claims, No Drawings

DETERGENT COMPOSITIONS INHIBITING DYE TRANSFER

FIELD OF THE INVENTION

The present invention relates to a composition and a process for inhibiting dye transfer between fabrics during washing.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of overcoming this problem would be to complex or adsorb the fugitive dyes washed out of dyed fabrics before they have the opportunity to become attached to other articles in the wash.

Polymers have been used within detergent compositions to inhibit dye transfer.

EP-A-O 102 923 describes the use of carboxyl containing polymers within an aqueous compositions.

DE-A-2 814 329 discloses the use of N-vinyl-oxazolidone polymers and FR-A-2 144 721 discloses the use of 15–35% of a copolymer of polyvinylpyrrolidone and acrylic acid nitrile or maleic anhydride within a washing powder.

EP-265 257 describes detergent compositions comprising an alkali-metal carboxy-metal carboxymethylcellulose, a vinylpyrrolidone polymer and a polycarboxylate polymer.

It is now surprisingly found that certain polyamine N-oxide polymers are very efficient in eliminating transfer of solubilized or suspended dyes. This finding allows to formulate compositions which exhibit excellent dye transfer inhibiting properties.

According to another embodiment of this invention a process is also provided for laundering operations involving colored fabrics.

SUMMARY OF THE INVENTION

The present invention relates to inhibiting dye transfer compositions comprising polyamine N-oxide polymers which contain units having the following structure formula:

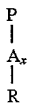

wherein P is a polymerisable unit, whereto the N—O group can be attached to or wherein the N—O group forms part of the polymerisable unit or a combination of both.

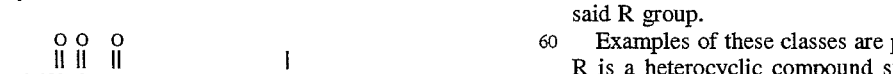

R are aliphatic, ethoxylated aliphatics, aromatic, heterocyclic or alicyclic groups or any combination thereof whereto the nitrogen of the N—O group can be attached or wherein the nitrogen of the N—O group form part of these groups.

DETAILED DESCRIPTION OF THE INVENTION

The compositions of the present invention comprise as an essential element polyamine N-oxide polymers which contain units having the following structure formula:

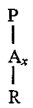

(I)

wherein P is a polymerisable unit, whereto the R—N—O group can be attached to or wherein the R—N—O group forms part of the polymerisable unit or a combination of both.

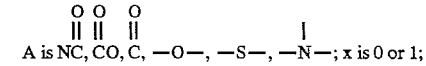

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

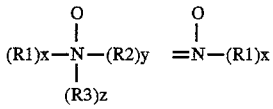

wherein R1, R2, R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine oxides can be obtained in almost any degree of polymerisation. The degree of polymerisation is not critical provided the material has the desired water-solubility and dye-suspending power.

Typically, the average molecular weight is within the range of 500 to 1000,000; preferably from 1,000 to 50,000, more preferably from 2,000 to 30,000, most preferably from 3,000 to 20,000.

The polyamine N-oxides of the present invention are typically present from 0.001 to 10% , more preferably from 0.01 to 2%, most preferred from 0.05 to 1% by weight of the dye transfer inhibiting composition.

The present compositions are conveniently used as additives to conventional detergent compositions for use in laundry operations. The present invention also encompasses dye transfer inhibiting compositions which will contain detergent ingredients and thus serve as detergent compositions.

Methods for making polyamine N-oxides:

The production of the polyamine-N-oxides may be accomplished by polymerizing the amine monomer and oxidizing the resultant polymer with a suitable oxidizing agent, or the amine oxide monomer may itself be polymerized to obtain the polyamine N-oxide.

The synthesis of polyamine N-oxide can be exemplified by the synthesis of polyvinyl-pyridine N-oxide. Poly-4-vinylpyridine ex Polysciences (mw. 50,000, 5.0 g., 0.0475 mole) was predisolved in 50 ml acetic acid and treated with a peracetic acid solution (25 g of glacial acetic acid, 6.4 g of a 30% vol. solution of $H_2O_2$, and a few drops of $H_2SO_4$ give 0.0523 mols of peracetic acid) via a pipette. The mixture was stirred over 30 minutes at ambient temperature (32° C.). The mixture was then heated to 80°–85° C. using an oil bath for 3 hours before allowing to stand overnight. The polymer solution then obtained is mixed with 11 of acetone under agitation. The resulting yellow brown viscous syrup formed on the bottom is washed again with 11 of aceton to yield a pale crystalline solid.

The solid was filtered off by gravity, washed with acetone and then dried over $P_2O_5$.

The amine:amine N-oxide ratio of this polymer is 1:4.

DETERGENT ADJUNCTS

A wide range of surfactants can be used in the detergent compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6-8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO\,(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula $$R^2-\underset{\underset{O}{|}}{C}-\underset{\underset{R^1}{|}}{N}-Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates builders for use herein include citric acid, preferably in the form of a water-soluble salt, derivatives of succinic acid of the formula R—CH(COOH) $CH_2$(COOH) wherein R is C10–20 alkyl or alkenyl, preferably C12–16, or wherein R can be substituted with hydroxyl, sulfo sulfoxyl or sulfone substituents. Specific examples include lauryl succinate , myristyl succinate, palmityl succinate2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as well as the corresponding soaps.

Preferred saturated species have from 12 to 16 carbon atoms in the alkyl chain. The preferred unsaturated fatty acid is oleic acid.

Preferred builder systems for use in granular compositions include a mixture of a water-insoluble aluminosilicate builder such as zeolite A, and a watersoluble carboxylate chelating agent such as citric acid.

Other builder materials that can form part of the builder system for use in granular compositions the purposes of the invention include inorganic materials such as alkali metal carbonates, bicarbonates, silicates, and organic materials such as the organic phosphonates, amiono polyalkylene phosphonates and amino polycarboxylates.

Other suitable water-soluble organic salts are the homo- or copolymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Other components used in detergent compositions may be employed, such as bleaches, bleach stabilizers or activators therefor, soil-suspending agents soil-release agents, optical brighteners, abrasives, bactericides, tarnish inhibitors, coloring agents, and perfumes.

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 millimicrons to 20 millimicrons and a specific surface area above 50 $m^2/g$ intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2 646 126 published Apr. 28, 1977. An example of such a compound is DC-544, commercially available from Dow Corning, which is a siloxane-glycol copolymer. Especially preferred suds controlling agent are the suds suppressor system comprising a mixture of silicone oils and 2-alkyl-alcanols. Suitable 2-alkyl-alcanols are 2-butyl-octanol which are commercially available under the trade name Isofol 12 R. Such suds suppressor system are described in Copending European Patent application N 92870174.7 filed 10 Nov. 1992.

Especially preferred silicone suds controlling agents are described in Copending European Patent application N°92201649.8. Said compositions can comprise a silicone/silica mixture in combination with fumed nonporous silica such as Aerosil®.

The suds suppressors described above are normally employed at levels of from 0.001% to 2% by weight of the composition, preferably from 0.01% to 1% by weight. The incorporation of the suds modifiers is preferably made as separate particulates, and this permits the inclusion therein of other suds controlling materials such as C20–C24 fatty acids, microcrystalline waxes and high MW copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Other detergent ingredients that can be included are detersive enzymes which can be included in the detergent formulations for a wide variety of purposes including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.05 mg to about 3 mg, of active enzyme per gram of the composition.

Suitable examples of proteases are the subtilisins which are obtained from particular strains of *B. subtilis* and *B. licheniforms*. Proteolytic enzymes suitable for removing protein-based stains that are commercially available include those sold under the tradenames Alcalase , Savinase and Esperase by Novo Industries A/S (Denmark) and Maxatase by International Bio-Synthetics, Inc. (The Netherlands) and FN-base by Genencor, Optimase and opticlean by MKC.

Of interest in the category of proteolytic enzymes, especially for liquid detergent compositions, are enzymes referred to herein as Protease A and Protease B. Protease A and methods for its preparation are described in European Patent Application 130,756, published Jan. 9, 1985, incorporated herein by reference. Protease B is a proteolytic enzyme which differs from Protease A in that it has a leucine substituted for tyrosine in position 217 in its amino acid sequence. Protease B is described in European Patent Application Serial No. 87303761.8, filed Apr. 28, 1987, incorporated herein by reference. Methods for preparation of Protease B are also disclosed in European Patent Application 130,756, Bott et al, published Jan. 9, 1985, incorporated herein by reference. Amylases include, for example, -amylases obtained from a special strain of *B. licheniforms*, described in more detail in British Patent Specification No. 1,296,839 (Novo), previously incorporated herein by reference. Amylolytic proteins include, for example, Rapidase, Maxamyl (International Bio-Synthetics, Inc.) and Termamyl, (Novo Industries).

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, incorporated herein by reference, which discloses fungal cellulase produced from *Humicola insolens*. Suitable cellulases are also disclosed in GB-A-2.075.028; GB-A-2.095.275 and DE-OS-2.247.832.

Examples of such cellulases are cellulases produced by a strain of *Humicola insolens* (*Humicola grisea* var. *thermoidea*), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Other suitable cellulases are cellulases originated from Humicola Insulens having a molecular weight of about 50 KDa, an isoelectric point of 5.5 and containing 415 amino acids. Such cellulase are described in Copending European patent application No. 93200811.3, filed Mar. 19, 1993. Especially suitable cellulase are the cellulase having color care benefits. Examples of such cellulases are cellulase described in European patent application No. 91202879.2, filed Nov. 6, 1991 Carezyme (Novo).

Suitable lipase enzymes for detergent usage include those produced by microorganisms of the Pseudomonas group, such as *Pseudomonas stutzeri* ATCC 19.154, as disclosed in British Patent 1,372,034, incorporated herein by reference. Suitable lipases include those which show a positive immunoligical cross-reaction with the antibody of the lipase, produced by the microorganism Pseudomonas fluorescent IAM 1057. This lipase and a method for its purification have been described in Japanese Patent Application 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P". Such lipases of the present invention should show a positive immunological cross reaction with the Amano-P antibody, using the standard and well-known immunodiffusion procedure according to Ouchterlony (Acta. Med. Scan., 133, pages 76–79 (1950)). These lipases, and a method for their immunological cross-reaction with Amano-P, are also described in U.S. Pat. No. 4,707,291, Thom et al, issued Nov. 17, 1987, incorporated herein by reference. Typical examples thereof are the Amano-P lipase, the lipase ex Pseudomonas fragi FERM P 1339 (available under the trade name Amano-B), lipase ex Pseudomonas nitroreducens var. lipolyticum FERM P 1338 (available under the trade name Amano-CES), lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*.

Especially suitable Lipase are lipase such as M1 Lipase (Ibis) and Lipolase (Novo).

Peroxidase enzymes are used in combination with oxygen sources, e.g. percarbonate, perborate, persulfate, hydrogen peroxide, etc. They are used for "solution bleaching", i.e. to prevent transfer of dyes of pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT Internation Application WO 89/099813, published Oct. 19, 1989, by O. Kirk, assigned to Novo Industries A/S, and in European Patent application EP No. 91202882.6, filed on Nov. 6, 1991.

A wide range of enzyme materials and means for their incorporation into synthetic detergent granules is also disclosed in U.S. Pat. No. 3,553,139, issued Jan. 5, 1971 to McCarty et al (incorporated herein by reference). Enzymes are further disclosed in U.S. Pat. No. 4,101,457, Place et al, issued Jul. 18, 1978, and in U.S. Pat. No. 4,507,219, Hughes, issued Mar. 26, 1985, both incorporated herein by reference. Enzyme materials useful for liquid detergent formulations, and their incorporation into such formulations, are disclosed in U.S. Pat. No. 4,261,868, Hera et al, issued Apr. 14, 1981, also incorporated herein by reference.

For granular detergents, the enzymes are preferably coated or prilled with additives inert toward the enzymes to minimize dust formation and improve storage stability. Techniques for accomplishing this are well-known in the art. In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate and calcium propionate. Calcium ions can be used in combination with short chain carboxylic acid salts, preferably formates. See, for example, U.S. Pat. No. 4,318,818, Letton, et al, issued Mar. 9, 1982, incorporated herein by reference. It has also been proposed to use polyols like glycerol and serbitel. Alkoxy-alcohols, dialkylglycoethers, mixtures of polyvalent alcohols with polyfunctional aliphatic amines (e.g., such as diethanolamine, triethanolamine, di-isopropanolamime, etc.), and boric acid or alkali metal borate. Enzyme stabilization techniques are additionally disclosed and exemplified in U.S. Pat. No. 4,261,868, issued Apr. 14, 1981 to Horn, et al. U.S. Pat. No. 3,600,319, issued Aug. 17, 1971 to Gedge, et al, both incorporated herein by reference, and European Patent Application Publication No. 0 199 405, Application No. 86200586.5, published Oct. 29, 1986, Venegas. Non-boric acid and borate stabilizers are preferred. Enzyme stabilization systems are also described, for example, in U.S. Pat. Nos. 4,261,868, 3,600,319 and 3,519,570.

Other suitable detergent ingredients that can be added are enzyme oxidation scavengers which are described in Copending European Patent aplication N 92870018.6 filed on Jan. 31, 1992. Examples of such enzyme oxidation scavengers are ethoxylated tetraethylene polyamines.

Especially preferred detergent ingredients are combinations with technologies which also provide a type of color care benefit. Examples of these technologies are cellulase and/or peroxidases and/or metallo catalysts for color maintance rejuvenation.

The detergent compositions according to the invention can be in liquid, paste or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid compositions according to the present invention can also be in "compact form", in such case, the liquid detergent compositions according to the present invention will contain a lower amount of water, compared to conventional liquid detergents.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. The pH of the treatment solution is preferably from 7 to 11, especially from 7.5 to 10.5.

The process and compositions of the invention can also be used as additive during laundry operations.

The following examples are meant to exemplify compositions of the present invention , but are not necessarily meant to limit or otherwise define the scope of the invention, said scope being determined according to claims which follow.

A liquid detergent composition according to the present invention is prepared, having the following compositions:

TABLE I

| % by weight of the total detergent composition | |
|---|---|
| Linear alkylbenzene sulfonate | 10 |
| Alkyl sulphate | 4 |
| Fatty alcohol ($C_{12}$-$C_{15}$) ethoxylate | 12 |
| Fatty acid | 10 |
| Oleic acid | 4 |
| Citric acid | 1 |
| NaOH | 3.4 |
| Propanediol | 1.5 |
| Ethanol | 10 |

The extent of dye transfer is assessed by a Hunter Colour measurement. The Hunter Colour system evaluates the colour of a fabric sample in terms of the Δc value which represents the change in the Hunter a, b values which are determined by reflecting spectrometrie. The Δc value is defined by the following equation:

$$\Delta c=\{(a_f-a_i)^2+(b_f-b_i)^2\}^{1/2}$$

where the subscripts i and f refer to the Hunter value before and after washing in the presence of the bleeding fabric, respectively. The least significant difference is 1% at 95% confidence level.

EXAMPLE I

The extent of dye transfer from different colored fabrics was studied using a launder-o-meter test that simulates a 30 min wash cycle. The launder-o-meter beaker contains 200 ml of a detergent solution, a 10 cm×10 cm piece of the colored fabric and a multifiber swatch which is used as a pick-up tracer for the bleeding dye. The multifiber swatch consists of 6 pieces (1.5 cm×5 cm each) of different material (polyacetate, cotton, polyamide, polyester, wool and orlon) which are sewn together.

Experimental Conditions pH=7.8

A: A detergent composition according to Table I which does not contain any dye transfer inhibition system.

B: A detergent composition according to Table I containing 10 ppm of PVNO (poly(4-vinylpyridine-N-oxide)) which has an average molecular weight of about 50,000 and an amine to amine N-oxide ratio of 1:4.

Results: Ac values for the cotton pick-up tracer.

| Bleeding fabric composition | Bleeding fabric color | A | B |
|---|---|---|---|
| 55% Linen/45% Polyester | Green | 4.2 | 1.7 |
| Jeans | Blue | 15.7 | 3.3 |
| 60% Polyester/40% Flax | Blue | 4.3 | 1.9 |
| 100% cotton | Brown | 7.6 | 0.8 |
| 100% Flax | Brown | 3.6 | 1.1 |

EXAMPLE II

The test of Example I was carried out using the following experimental conditions:

pH=7.8

A: A detergent composition according to Table I without any dye transfer inhibition system B: A detergent composition according to Table I containing 100 ppm of poly(2-vinylpyridine-N-oxide) which has an average molecular weight of about 50,000 and an amine to amine N-oxide ratio of 1:4.

Results: Δc values for the cotton pick-up tracer.

| Bleeding fabric composition | Bleeding fabric color | A | B |
|---|---|---|---|
| 33% Viscose/67% Polyester | Green | 10.0 | 4.9 |
| 35% Viscose/65% Polyester | Blue | 4.9 | 0.8 |
| 100% cotton | Black | 3.5 | 2.2 |
| Jeans | Blue | 15.7 | 14 |
| 60% Polyester/40% Flax | Blue | 4.3 | 2.3 |
| 100% cotton | Brown | 7.6 | 5.9 |
| 60% Wool/40% Polyamide | Mauve | 2.2 | 1.1 |

EXAMPLE III

The extent of dye transfer from brown cotton fabric was studied using a launder-o-meter test which simulates a 30 min wash cycle. The launder-o-meter beaker contains 400 ml of a detergent solution, a 20 cm piece of the colored fabric and two multifiber swatches which are used as a pick-up tracer for the bleeding dye.

pH=10.5

A: A detergent composition according to Table I without any dye transfer inhibition system B: A detergent composition according to Table I containing 70 ppm of poly 2-(Dimethylamino)-ethylmethacryllate-N-oxide which has an average molecular weight of about 100,000.

Results: Δc values for the cotton pick-up tracer.

| Bleeding fabric composition | Bleeding fabric color | A | B |
|---|---|---|---|
| 100% Cotton | Brown | 4.0 | 2.5 |

EXAMPLE IV

The extent of dye transfer from brown cotton fabric was studied using a launder-o-meter test which simulates a 30 min wash cycle. The launder-o-meter beaker contains 200 ml of a detergent solution, a 4 cm×10 cm piece of the colored fabric and two multifiber swatches which are used as a pick-up tracer for the bleeding dye.

pH=10.5

A: A detergent composition according to Table I without any dye transfer inhibition system B: A detergent composition according to Table I containing 7 ppm (B1), 35 ppm (B2) and 70 ppm (B3) of poly-t-vinylimidazole-N-oxide which has an average molecular weight of about 150,000

Results: Δc values for the cotton pick-up tracer.

| Bleeding fabric composition | Bleeding fabric color | A | B1 | B2 | B3 |
|---|---|---|---|---|---|
| 100% cotton | Brown | 16.9 | 5.5 | 3.6 | 2.1 |
| 100% cotton | Blue | 11.1 | 8.5 | 6.2 | 3.9 |

EXAMPLE V

The dye transfer inhibition performance of poly (Dimethylamino)-ethylmethacryllate-N-oxide was tested in a domestic washing machine using a 40° C. cycle. The washing machine loads consisted of ballast laundry and 1000 $cm^2$ of a known bleeding fabric. A 26 cm by 31 cm terry towel was used as the pick-up tracer for the bleeding dye.

pH=10.5

A: detergent solution without any dye transfer inhibition system

B: detergent solution which delivers 7 ppm of poly-dialkylmethylamine-N-oxide in the wash solution (average molecular weight range of about 150,000).

Results: Δc values for the cotton pick-up tracer.

| Bleeding fabric composition | Bleeding fabric color | A | B |
|---|---|---|---|
| 100% cotton | Brown | 15.9 | 11.9 |
| 100% cotton | Blue | 8.08 | 2.8 |

EXAMPLE VI

The dye transfer inhibition performance of poly(4-vinylpyridine)-N-oxide was tested in a domestic washing machine using a 40° C. cycle. The washing machine loads consisted of ballast laundry and 1000 $cm^2$ of a known bleeding fabric. A 26 cm by 31 cm terry towel was used as the pick-up tracer for the bleeding dye.

Test Conditions

A: detergent without any dye transfer inhibition system

B: detergent composition which delivers 7 ppm of poly(4-vinylpyridine-N-oxide) in the wash solution (average molecular weight is about 50,000).

TABLE 1

| Dye | C.I. # | A | B |
|---|---|---|---|
| Δc values at wash pH of 7.8 | | | |
| Direct Blue 90 | n/a | 8.1 | 0.7 |
| Direct Red 80 | 35780 | 24.8 | 3.4 |
| Direct Brown 90 | 31785 | 14.2 | 0.6 |
| Acid Red 151 | 26900 | 5.1 | 4.6 |
| Δc values at wash pH of 9.8 | | | |
| Direct Blue 90 | n/a | 4.7 | 3.9 |
| Direct Red 80 | 35780 | 33.0 | 17 |
| Direct Brown 90 | 31785 | 13.4 | 2.0 |

EXAMPLE VII

The effect of degree of oxidation of polyvinylpyridine-N-oxide (PVNO) on the DTI performance was evaluated in a launder-o-meter test which simulates a 30 min wash cycle. The dye transfer inhibition capacity of the different PVNO samples was tested using the same amount of a cotton bleeding fabric dyed with Direct Blue 90. The pick-up tracer for dye transfer is a multifiber swatch.

The extent of dye transfer is reported in terms of the Hunter ΔE value which is calculated versus a reference washed in the absence of the bleeding fabric.

Experimental Conditions 10 ppm of PVNO (Average MW 60,000) in a detergent solution according to Table I.

The oxidation degree was determined by Nuclear Magnetic resonance (NMR).

Results: ΔE values as a function of PVNO degree of oxidation (lower ΔE means better performance)

Reference ΔE in the absence of PVNO is 17.0

| Oxidation degree (%) | ΔE |
|---|---|
| 35 | 16.4 |
| 40 | 15.9 |
| 58 | 11.3 |
| 73 | 10.6 |
| 83 | 8.3 |
| 92 | 6.7 |

Conclusion: The dye transfer inhibition properties of PVNO improve with higher degree of oxidation.

EXAMPLE VIII

A liquid detergent composition according to the present invention is prepared, having the following compositions:

| | |
|---|---|
| Linear alkylbenzene sulfonate | 10 |
| Alkyl sulphate | 4 |
| Fatty alcohol ($C_{12}$–$C_{15}$) ethoxylate | 12 |
| Fatty acid | 10 |
| Oleic acid | 4 |
| Citric acid | 1 |
| Diethylenetriaminepentamethylene Phosphonic acid | 1.5 |
| NaOH | 3.4 |
| Propanediol | 1.5 |
| Ethanol | 10 |
| Ethoxylated tetraethylene pentamine | 0.7 |
| Poly(4-vinylpyridine)-N-oxide | 0.3 |
| Thermamyl | 0.13 |
| Carezyme | 0.014 |
| FN-Base | 1.8 |
| Lipolase | 0.14 |
| Endoglucanase A | 0.53 |
| Suds supressor (ISOFOL[r]) | 2.5 |
| Minors | up to 100 |

EXAMPLE IX

A compact granular detergent composition according to the present invention is prepared, having the following formulation:

| | |
|---|---|
| Linear alkyl benzene sulphonate | 11.40 |
| Tallow alkyl sulphate | 1.80 |
| $C_{45}$ alkyl sulphate | 3.00 |
| $C_{45}$ alcohol 7 times ethoxylated | 4.00 |
| Tallow alcohol 11 times ethoxylated | 1.80 |
| Dispersant | 0.07 |
| Silicone fluid | 0.80 |
| Trisodium citrate | 14.00 |
| Citric acid | 3.00 |
| Zeolite | 32.50 |

-continued

| | |
|---|---|
| Maleic acid actylic acid copolymer | 5.00 |
| DETMPA | 1.00 |
| Cellulase (active protein) | 0.03 |
| Alkalase/BAN | 0.60 |
| Lipase | 0.36 |
| Sodium silicate | 2.00 |
| Sodium sulphate | 3.50 |
| Glucose | 10.00 |
| Poly(4-vinylpyridine)-N-oxide | 0.3 |
| Minors | up to 100 |

We claim:

1. A dye transfer inhibiting detergent composition comprising a) 0.0001% to 10% by weight of a dye transfer inhibitor having a ratio of amine to amine N-oxide of from about 2:3 to about 1:1.000.000 selected from the group consisting of poly(2-vinylpyridine-N-oxide), poly-2-(dimethylamino)-ethylmethacrylate-N-oxide and poly-1-vinylimidazole-N-oxide; and b) a detersive effective amount of a surfactant; and c) a detersive effective amount of a builder.

2. A dye transfer inhibiting detergent composition according to claim 1 in the form of a non-dusting granule or a liquid.

3. A dye transfer inhibiting detergent composition according to claim 1 which additionally comprises enzymes, chelants, bleaching agents, soil-suspending agents, suds suppressors, soil release agents, optical brighteners, abrasives, bactericides, tarnish inhibitors, coloring agents, perfumes or mixtures thereof.

* * * * *